United States Patent [19]

Koch

[11] 4,181,624

[45] Jan. 1, 1980

[54] AMINOALKANOLS

[75] Inventor: Karl H. Koch, Haan, Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 889,989

[22] Filed: Mar. 24, 1978

Related U.S. Application Data

[63] Continuation of Ser. No. 683,319, May 5, 1976, abandoned, which is a continuation-in-part of Ser. No. 521,245, Nov. 6, 1974, abandoned.

[30] Foreign Application Priority Data

Nov. 10, 1973 [DE] Fed. Rep. of Germany ..... 2356322

[51] Int. Cl.[2] ..... C07C 91/02

[52] U.S. Cl. ..... 252/182; 72/42; 106/14.15; 106/14.31; 106/14.42; 252/392; 260/584 R; 422/12; 562/564

[58] Field of Search ..... 252/182; 260/584 R, 260/534 M; 72/42; 562/564; 253/392; 106/14.31, 14.42, 14.15; 422/12

[56] References Cited

U.S. PATENT DOCUMENTS

| | | | |
|---|---|---|---|
| 3,139,457 | 6/1964 | Lapporte et al. | 260/584 R |
| 3,428,684 | 2/1969 | Tindall | 260/584 R |
| 3,499,931 | 3/1970 | Tindall | 260/584 R |
| 3,723,530 | 3/1973 | Goetze et al. | 260/584R |
| 3,766,184 | 10/1973 | Johansson | 260/584 R |
| 3,872,116 | 3/1975 | Gipson | 260/584 R |
| 3,953,512 | 4/1976 | Belzecki et al. | 260/584 R |

*Primary Examiner*—Benjamin R. Padgett
*Assistant Examiner*—Irwin Gluck
*Attorney, Agent, or Firm*—Hammond & Littell

[57] ABSTRACT

The invention provides novel mixtures of at least two aminoalkanols of the formula:

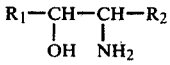

wherein $R_1$ and $R_2$ each represent a $C_{1-21}$ alkyl and the sum of the carbon atoms in $R_1$ and $R_2$ is 6 to 22; and the $R_1$—CH—CH—$R_2$ units are mixtures containing 8 to 24 carbon atoms of at least two compounds. The vicinal OH and $NH_2$ substituents are uniformly distributed statistically along the chain. The mixtures are readily prepared from mixtures of $C_8$-$C_{24}$ olefins by epoxidation followed by reaction with ammonia.

The mixtures are useful as intermediates in the production of hydroxyalkyl-aminobutyric acid mixtures for lubricating the cold working of aluminum and as corrosion inhibitors for corrodible iron-containing metals.

8 Claims, No Drawings

AMINOALKANOLS

FIELD OF THE INVENTION

This is a continuation of my copending application Ser. No. 683,319, filed May 5, 1976, now abandoned which is a continuation-in-part of application Ser. No. 521,245, filed Nov. 6, 1974, now abandoned, which describes certain vicinal aminoalkanol mixtures as starting materials in the production of hydroxyalkylaminobutyric acid mixtures for lubricating the cold working of aluminum.

The present invention relates to these aminoalkanol mixtures which are also useful as corrosion inhibitors in free base and in salt form and to methods for the preparation of said mixtures.

BACKGROUND OF THE INVENTION

My parent application discloses both aminoalkanol mixtures of the formula:

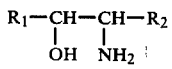

wherein $R_1$ and $R_2$ each represent a $C_1$–$C_{20}$ alkyl, with the provisos that the sum of the carbon atoms in both $R_1$ and $R_2$ is 6 to 20 and that the vicinal OH and $NH_2$ substituents are distributed randomly over the chain, and aminoalkanol mixtures where the substituents are terminal. Both types are useful in the production of the hydroxyalkyl-aminobutyric acid mixtures for lubricating the cold working of aluminum.

The corrosion of iron-containing metals (particularly steel) by aqueous fluids is a major source of loss to industry. It has long been known that such corrosion can be inhibited by a variety of means, perhaps the simplest of which is the application to the metal of a hydrophobic material. Modern safety and ecological requirements make it very desirable that the hydrophobic material be substantially non-odorless and substantially harmless to the eyes and skins of humans. The amines of naturally occurring fat materials have been used for the purpose, but usually have a strong and unpleasant odor and are very irritating (and sometimes dangerously harmful) to the skin and eyes.

OBJECTS OF THE INVENTION

It is a principal object of the invention to find mixtures of non-terminal aminoalkanols which are useful in the production of hydroxyalkyl-aminobutyric acid mixtures for lubricating the cold working of aluminum and which also can be applied directly to steel and other corrodible metals, and which will greatly decrease the tendency of such metals to corrode when contacted with aqueous fluids (including aqueous solutions of strong acids).

It is a still further object to provide such a mixture of non-terminal aminoalkanols which possesses a mild and inoffensive odor and which will have a comparatively low capability for irritating human eyes and skin.

THE INVENTION

The foregoing and other objects are obtained by the present invention. I have found that mixtures of at least two aminoalkanols of the formula:

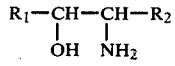

wherein $R_1$ and $R_2$ each represent an alkyl substituent of 1 to 21 carbon atoms, the sum of the number of carbon atoms in said $R_1$ and $R_2$ substituents being 6 to 22; the

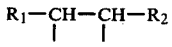

units in said formula being mixtures containing 8 to 24 carbon atoms, are useful in the production of hydroxyalkyl-aminobutyric acid mixtures and are also effective and safe corrosion inhibitors for metals.

In the aminoalkanols of the present invention the position of the vicinal OH and $NH_2$ substituents is not critical as long as these substituents are in non-terminal positions (i.e., wherein neither $R_1$ nor $R_2$ in the above formula represents H). Such mixtures of aminoalkanols where the vicinal substituents are non-terminal and are uniformly distributed along the $R_1$—CH—CH—$R_2$ chains have provided superior results.

The aminoalkanols are useful in the free base form, and also, as corrosion inhibitors, in the form of their salts with aliphatic carboxylic acids of 2 to 24 carbon atoms.

The preparation of the mixtures of aminoalkanols of the invention preferably starts with mixtures of monoolefins of 8 to 24 carbon atoms having non-terminal double bonds formed by dehydrogenation of $C_8$–$C_{24}$ paraffins, for example by catalytic dehydrogenation or by chlorination followed by dehydrochlorination of mixtures of alkanes. In each instance, any polyolefins and non-terminally unsaturated monoolefins formed by the reactions are removed, for example by distillation or by selective extraction. The resulting mixtures of monoolefins are known. It is also practical to use mixtures of such monoolefins with saturated hydrocarbons (such as are used for the preparation of these olefins) since the saturated hydrocarbons are essentially inert and thus act only as diluents.

The fractions of non-terminally unsaturated monoolefins with a high content of linear $C_{11}$–$C_{14}$ or $C_{15}$–$C_{18}$ olefins, particularly those with the chain length distribution indicated below, are preferably employed. These lead to aminoalkanols of the formula given above wherein the sum of the carbon atoms in $R_1$ and $R_2$ is between 9 and 12 in the first instance and between 13 and 16 in the second instance.

The following illustrates the composition of typical monoolefin mixtures which are preferred as raw materials for the preparation of aminoalkanols according to the present invention.

| Olefin Fractions | |
|---|---|
| Fraction | Approx. wt. |
| (a) $C_{11}$ - $C_{14}$ | |
| $C_{11}$ | 22 |
| $C_{12}$ | 30 |
| $C_{13}$ | 26 |
| $C_{14}$ | 22 |
| (b) $C_{15}$ -$C_{16}$ | |
| $C_{15}$ | 26 |
| $C_{16}$ | 35 |
| $C_{17}$ | 31 |

-continued

| Olefin Fractions | |
|---|---|
| Fraction | Approx. wt. |
| $C_{18}$ | 6 |

For the preparation of the aminoalkanols of the invention a mixture of monoolefins of specified chain length is first epoxidized by peracetic acid or by any other convenient method and the epoxy mixtures thus obtained (epoxy alkanes) are reacted with ammonia in the presence of water at elevated temperature under autogeneous pressure. The reaction product is a mixture of the desired aminoalkanols as one phase, and aqueous ammonia as the other phase.

The ammonia is used in a 5- to 20-fold, preferably in a 10- to 15- fold molar excess based on the epoxy groups present, while water is added in 1- to 20-fold, preferably 5- to 15-fold molar excess, again based on the number of epoxy groups present.

The reaction is carried out in an autoclave fitted with a propeller stirrer at a temperature of 160° to 220° C., preferably 190° to 210° C. at a pressure of about 40 to 150 atmospheres.

The time required for the reaction runs from 0.25 to 10 hours but often 0.5 to 1 hour is sufficient.

The reaction product separates into two phases, the aminoalkanol phase and the ammonia-water phase. The aminoalkanol phase is removed and is purified by distillation or other convenient method.

Salts of the aminoalkanol mixtures can be prepared by known methods. The aliphatic carboxylic acids of 2 to 24 carbon atoms are employed, which can be water-soluble (e.g., acetic and lactic) or water-insoluble (e.g., caproic acid, lauric acid, palmitic acid, behenic acid, myristoleinic acid, oleic acid and linolenic acid).

The hydroxyalkyl-aminobutyric acids are obtained by the reaction of the above hydroxyalkylamines with crotonic acid in an aqueous solution at elevated temperatures. The concentrations employed are such that, after heating the reaction mixture at temperatures up to the reflux for ½ hour to 10 hours, the hydroxyalkyl-aminobutyric acid is obtained in aqueous concentrates of from 45% to 60% by weight of the acid.

The hydroxyalkyl-aminobutyric acid can be recovered from these aqueous concentrates by the customary methods, such as evaporation of the water under vacuum. However, for purposes of obtaining the aqueous lubricant preparations, the concentrates may simply be diluted with water.

The lubricants for the cold working of aluminum and aluminum alloys contain the hydroxyalkyl-aminobutyric acids in an amount of 0.1% to 10%, preferably 0.5% to 5% by weight, related to the entire aqueous lubricant.

The aminoalkanol mixtures according to the invention are also effective per se as corrosion inhibitors when dissolved in fuels, oils and lubricants. They can be appled as solutions in organic solvents, particularly as 0.1% to 10% by weight solutions, to prevent corrosion, as described in copending, commonly-assigned U.S. Patent Application Ser. No. 683,516, now abandoned, filed concurrently herewith (Attorney's Docket No. A-5073-2). The solutions are applied directly to the surfaces to be protected. Compared to fatty amines prepared from naturally-occurring fatty material such as are generally used as corrosion inhibitors, the aminoalkanol mixtures of the invention provide much better protection and can be handled more easily because of their low solidification points.

Another advantage of the agents of the present invention is that they are less objectionable to use than the amines of naturally-occurring fatty products because they have a milder odor and because they have less tendency to irritate the eyes and skin.

The invention is described more fully in the examples which follow. These examples illustrate the invention and are not to be construed in limitation thereof.

A - Preparation of Aminoalkanol Mixtures

The designations $C_{11}$–$C_{14}$ and $C_{15}$–$C_{18}$ epoxides used in the examples mean mixtures of epoxidized olefins which have statistically (i.e., uniformly) distributed non-terminal double bonds having the chain length distributions indicated in the description. The products are alkane epoxides.

EXAMPLE 1

198 g. (approx. 1 mol) of a mixture of $C_{11}$–$C_{14}$ alkane epoxides, 170 g. (10 mols) of ammonia, and 180 g. (10 mols) of water are stirred in a 3-liter steel autoclave having a stroke-type stirrer for half an hour at 200° C. During the reaction a maximum pressure of 80 atmosphere is established autogenously. At the end of the reaction the mixture is allowed to cool to room temperature and the aminoalkanol mixture is separated from the ammonia-water phase. The separated product is purified by distillation. A yield of 189 g. of the mono (hydroxyalkyl) -amine is obtained, corresponding to 91% of theory. Boiling range: 93°–96° C. at 0.1 Torr.; solidification point: −5° C.; index of refraction at 20° C. 1.4586; amine number: found, 268; calculated: 271. The di-(hydroxyalkyl)-amine is formed in an amount of 8% of the theory.

EXAMPLE 2

A mixture of 255 g. (approx. 1 mol) of $C_{15}$–$C_{18}$ alkane epoxide mixture, 255 g. (15 mols) of ammonia, and 270 g. (15 mols) of water is stirred for 1 hour at a reaction temperature of 200° C. in a three-liter steel autoclave having a stroke stirrer. The maximum autogeneous pressure is 80 atmospheres. After cooling to room temperature, the aminoalkanol phase is separated and purified. A yield of 223 g. of the mono (hydroxyalkyl) amine is obtained corresponding to 86% of the theory. Boiling range: 116°–121° C. at 0.1 Torr; solidification point: 16° C.; index of refraction at 20° C.: 1.4610; amine number; found, 204: calculated, 216. The di(hydroxyalkyl-) amine was formed in an amount of 12% of theory.

EXAMPLE 3

510 g. (approx. 2 mols) of a $C_{15}$–$C_{18}$ mixture of alkane epoxides and 340 g. (20 mols) of ammonia are reacted in separate tests with amounts of water shown in the table below. The reactions are carried out in a three-liter autoclave having a propeller stirrer at 200° C. over five hours. The results are shown in Table 1.

TABLE I

| Mols | Yield (% of Theory) Hydroxyalkylamine | | Max. React. Pressure |
|---|---|---|---|
| Water | Mono | Di | (Atmos.) |
| 0 | 14 | 5 | 159 |
| 2 | 70 | 14 | 150 |
| 4 | 82 | 11 | 134 |
| 6 | 85 | 10 | 125 |
| 8 | 86 | 9 | 112 |

TABLE I-continued

| Mols Water | Yield (% of Theory) Hydroxyalkylamine Mono | Di | Max. React. Pressure (Atmos.) |
|---|---|---|---|
| 10 | 87 | 8 | 101 |
| 12 | 89 | 7 | 97 |
| 14 | 88 | 7 | 93 |
| 16 | 90 | 5 | 90 |

EXAMPLE 4

Another series of reactions was carried out with 510 g. (approx. 2 mols) of $C_{15}$–$C_{18}$ epoxide mixture, 180 g. (10 mols) of water and 5, 10, 15 and 20 mols of ammonia in a three-liter autoclave provided with stroke stirrer at a temperature of 200° C. over five hours. The results are compiled in Table II.

TABLE II

| Mols Ammonia | Yield (% of Theory) Hydroxyalkylamine Mono | Di | Max. React. Pressure (Atmos.) |
|---|---|---|---|
| 5 | 34 | 52 | 38 |
| 10 | 75 | 23 | 56 |
| 15 | 86 | 12 | 77 |
| 20 | 87 | 8 | 101 |

B - Application

First, about 55% aqueous concentrates of the hydroxyalkyl-aminobutyric acids to be tested were produced by reacting substantially equimolar amounts of corresponding hydroxyamines with crotonic acid in an aqueous solution.

EXAMPLE 5

215.0 gm of an internal hydroxy-dodecyltetradecylamine (formed from aminating the epoxide of about a 1 to 1 mixture of non-terminal dodecene and tetradecene)

86.1 gm of crotonic acid 250.0 gm of water were heated for 10 hours, with stirring, to 100° C. When at the temperature of 100° C., two liquid phases were formed, but on cooling to room temperature, an about 55%, clear, homogenous solution was again obtained.

EXAMPLE 6

200.0 gm of an internal hydroxy-pentadecylhexadecyl-amine (formed from aminating the epoxide of about a 1 to 1 mixture of non-terminal pentadecene and hexadecene)

59.1 gm of crotonic acid 212.0 gm of water were heated for 7 hours, with stirring, to 100° C. In this case, two liquid phases were formed when hot, which remained, however, on cooling. The solution obtained was about 55%.

EXAMPLE 7

Corrosion prevention tests were carried out with the following agents. The salts were prepared by mixing the indicated aminoalkanol mixtures with the indicated organic acids.

| Exp. | Chain Length | Acid Added |
|---|---|---|
| A | $C_{11}$–$C_{14}$ | None |
| B | $C_{15}$–$C_{18}$ | None |

-continued

| Exp. | Chain Length | Acid Added |
|---|---|---|
| C | $C_{11}$–$C_{14}$ | Oleic |
| D | $C_{15}$–$C_{18}$ | Oleic |
| E | $C_{11}$–$C_{14}$ | Lactic |
| F | $C_{15}$–$C_{18}$ | Lactic |

The following amines were included in the tests for comparison:

| | |
|---|---|
| G | Dodecylamine |
| H | Distilled tallow amine |
| I | Distillied coconut amine |
| J | Dodecyl aminopropyl amine |

The above materials were oil soluble and were tested according to the static water drop test [see H. R. Baker, D. T. Jones and W. A. Zisman; Ind. Eng. Chem. 41, 137 (1949)]. The test plates used are equilateral triangles of steel (RRST 1403 m) with a side length of 45 mm. and with the corners bent down obliquely; the center of the triangular surface contained a circular depression 19 mm. in diameter. These plates are coated with a 1% solution of the test substances in ligroin, after which the ligroin was allowed to evaporate. Into each of the depressions were put three drops of a 3% aqueous common salt solution. The results were evaluated by visual determination of the amount of rust formed, as a percentage of the amount formed by the blank. The results of the tests are shown in Table III.

TABLE III

| Agent Blank | Corrosion Test Results Amount of Rust (% of Blank) After 1 Day 100% | After 2 Days 100% |
|---|---|---|
| A | 0–5 | 0–5 |
| B | 10 | 10 |
| C | 0 | 0 |
| D | 0–5 | 0–5 |
| E | 0 | 0 |
| F | 5 | 5 |
| G | 40–50 | 40–50 |
| H | 30 | 40 |
| I | 30 | 30 |

The mixtures according to the invention and their salts show a good corrosion inhibiting effect in the water drop test. Best results were obtained when the aminoalkanols were present in the form of their salts with an organic acid and when the sum of the carbon atoms in the $R_1$ and $R_2$ substituents of the aminoalkanol was 9 to 12.

EXAMPLE 8

The corrosion inhibiting properties of the aminoalkanols in the acid medium were determined by the column test [see E. G. Nottes, Erdöl and Kohle, 15, 640 (1962)]. In this test a cleaned test strip of steal (RST 1404) measuring 150×10×mm. is exposed in a distillation column for 1.5 hours to the vapor distilling from a mixture of hydrocarbons (300 ml. of toluene 300 ml. of xylene, 400 ml. of ligroin) and dilute hydrochloric acid (70 ml. of 2 N hydrochloric acid), and at the same time the strip is wetted continuously with a 1% solution of an aminoalkanol mixture in ligroin (ab. 0.5 drops/sec.). The hydrochloric acid converts the aminoalkanol to salt form. At the conclusion of the test, the weight lost by the strip is determined. In a blank test, a test strip is wetted with drops of ligroin during the distillation. The results are shown in Table IV.

TABLE IV

| Column Test | |
|---|---|
| Product | Loss in Weight (mg.) |
| Blank | 95 |
| A | 25 |
| B | 23 |
| G | 42 |
| H | 42 |
| I | 30 |

EXAMPLE 9

C. Skin Tolerance Test

The effect of the aminoalkanols mixtures of the invention on skin was determined by the use of hairless mice. To this end the aminoalkanols were prepared as 1% and 2.5% solutions in olive oil, and about 100 mg. of each preparation was applied to the back skin of the mice once a day for about one week. A group of five test animals was used for each agent tested.

The reaction of the skin regarding reddening, swelling, pigmentation, scaling and necroses was rated daily. The results of the tests are shown in Table V.

TABLE V

| Skin Tolerance | | |
|---|---|---|
| Agent | Conc. | Reaction |
| A | 2.5% | No reaction |
| B | 2.5% | Reddeing and slight sealing after four days |
| G | 2.5% | Necrotic changes |
| J | 1.0% | Pronounced reddening after 4 days; reddening and eczemas after 5 days. |

EXAMPLE 10

D. Local Tolerance

The local tolerance of membranes for the aminoalkanol mixtures of the invention was determined by dropping small amounts of 2.5% solutions of the test substances in olive oil once into the conjuctival sac of one eye of groups of albino rabbits. The reactions of the mucous membranes of the eye of this solution were evaluated according to the point system of Draize [Appraisal of the Safety of Chemicals in Foods, Drugs and Cosmetics., Assn. of Food and Drug Officials of the U.S., pp. 49–52 (1959)] at the end of the following lengths of time after application: 2 hours, and 1, 2, 4, 6 and 8 days. The results of the test are shown in Table VI.

TABLE VI

| Mucous Membrane Tolerance | | |
|---|---|---|
| Agent | Conc. | Reaction |
| A | 2.5% | Moderate conjutival reaction disappeared almost completely after 24 hours, and gone after 2 days. |
| B | 2.5% | Moderate conjuctival reaction gone after 2 days. |
| G | 2.5% | Moderate connunctival reaction gone after 4 days. |
| J | 1.0% | Strong conjuctival reaction after 8 days 30 to 40% of the maximum reaction remained. |

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. Mixtures of at least two aminoalkanols of the formula:

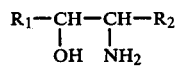

wherein $R_1$ and $R_2$ represent $C_{1-21}$ alkyl; and wherein the sum of the carbon atoms in $R_1$ and $R_2$ is between 6 and 22 and the vicinal substituents are uniformly distributed along the $R_1$—CH—CH—$R_2$ chain.

2. Aminoalkanol mixtures of claim 1 wherein the sum of the carbon atoms in $R_1$ and $R_2$ is between 9 and 12.

3. Aminoalkanol mixtures of claim 1 wherein the sum of carbon atoms in $R_1$ and $R_2$ is between 13 and 16.

4. Salts of the aminoalkanol mixtures of claim 1 with aliphatic carboxylic acids of 2 and 24 carbon atoms.

5. A method for the preparation of the aminoalkanol mixture of Claim 1, which comprises forming a reaction mixture of (a) 1 mol of non-terminal epoxy alkanes produced by dehydrogenating a mixture of $C_8$–$C_{24}$ paraffins, removing any polyolefins and terminally-unsaturated olefins normally thereby produced, and epoxidizing the residue, (b) 5 to 20 mols of ammonia, and (c) 1 to 20 mols of water, and heating the mixture under autogenous pressure in an autoclave at 160° C. to 220° C. until the mixture has come to substantial chemical equilibrium.

6. A method according to claim 5 wherein the amount of ammonia is 10 to 15 mols.

7. A method according to claim 5 wherein the amount of water is 5 to 15 mols.

8. A method according to claim 5 wherein the temperature of the mixture in the autoclave is 190° C. to 210° C.

* * * * *